US009736561B2

(12) United States Patent
Wiklof et al.

(10) Patent No.: US 9,736,561 B2
(45) Date of Patent: Aug. 15, 2017

(54) SMARTPEN CONFIGURED FOR HANDS FREE AUDIO RECORDING

(71) Applicant: EMPIRE TECHNOLOGY DEVELOPMENT LLC, Wilmington, DE (US)

(72) Inventors: Christopher A. Wiklof, Everett, WA (US); Anna Marie Portinga, Seattle, WA (US)

(73) Assignee: EMPIRE TECHNOLOGY DEVELOPMENT LLC, Wilmington, DE (US)

( * ) Notice: Subject to any disclaimer, the term of this patent is extended or adjusted under 35 U.S.C. 154(b) by 369 days.

(21) Appl. No.: 14/054,851

(22) Filed: Oct. 16, 2013

(65) Prior Publication Data

US 2014/0044278 A1 Feb. 13, 2014

Related U.S. Application Data

(63) Continuation of application No. PCT/US2011/033138, filed on Apr. 20, 2011.

(51) Int. Cl.

| | |
|---|---|
| ***H04R 1/02*** | (2006.01) |
| ***H04R 1/34*** | (2006.01) |
| ***H04R 5/027*** | (2006.01) |

(52) U.S. Cl.

CPC ..... *H04R 1/028* (2013.01); *H04R 1/34* (2013.01); *H04R 5/027* (2013.01)

(58) Field of Classification Search

None

See application file for complete search history.

(56) References Cited

U.S. PATENT DOCUMENTS 5,898,427 A * 4/1999 Okamoto ..... G06F 1/1626 178/19.01

6,529,920 B1 3/2003 Arons et al.

(Continued)

FOREIGN PATENT DOCUMENTS

CN 2220711 Y 2/1996

CN 1750550 A 3/2006

(Continued)

OTHER PUBLICATIONS

English translation of CN201283719. Lian et al. "Intelligent writing pen." Aug. 5, 2009. pp. 1-9.*

(Continued)

*Primary Examiner* — Curtis Kuntz

*Assistant Examiner* — Qin Zhu

(74) *Attorney, Agent, or Firm* — Turk IP Law, LLC

(57) ABSTRACT

A smartpen configured for hands free audio recording is disclosed. One example smartpen may be configured so that a microphone contained in the smartpen is automatically oriented for unobstructed reception of ambient sound when the smartpen is placed on a supporting surface. Another example smartpen may have a weight distribution that causes the smartpen to roll to a desired orientation of the microphone when the smartpen is placed on a supporting surface with the microphone in a different orientation. Still another example smartpen may have one or more surface features disposed on a surface of the body of the smartpen, where the surface features are configured to position the microphone in a desired orientation when the smartpen is placed on a supporting surface.

4 Claims, 3 Drawing Sheets

(56) References Cited

U.S. PATENT DOCUMENTS

| | | | | |
|---|---|---|---|---|
| 2006/0233406 | A1* | 10/2006 | Fischer | H04R 1/406 381/313 |
| 2007/0176909 | A1* | 8/2007 | Pavlowski | G06F 3/03545 345/179 |
| 2009/0022332 | A1* | 1/2009 | Van Schaack | G06F 3/03545 381/71.1 |
| 2009/0251336 | A1 | 10/2009 | Marggraff et al. | |
| 2009/0251442 | A1* | 10/2009 | Nakata | G06F 3/046 345/179 |
| 2010/0054845 | A1* | 3/2010 | Marggraff | G06F 3/03545 401/195 |
| 2010/0085471 | A1* | 4/2010 | Craven-Bartle | G06F 3/03545 348/371 |
| 2010/0134848 | A1* | 6/2010 | Lynggaard | G06F 3/03545 358/3.28 |
| 2011/0078151 | A1* | 3/2011 | Bilbrey | G06F 3/03545 707/746 |
| 2011/0148763 | A1* | 6/2011 | Yamamoto | G06F 3/0317 345/158 |
| 2011/0164001 | A1* | 7/2011 | Seo | G06F 3/03545 345/179 |
| 2012/0206555 | A1* | 8/2012 | Yoshida | B60R 11/0241 348/14.02 |
| 2013/0201162 | A1* | 8/2013 | Cavilia | G06F 3/03545 345/179 |

FOREIGN PATENT DOCUMENTS

| | | | |
|---|---|---|---|
| CN | 1770076 | A | 5/2006 |
| CN | 2804953 | Y | 8/2006 |
| CN | 201260161 | Y | 6/2009 |
| CN | 201667664 | U | 12/2010 |
| WO | 2008150916 | A1 | 12/2008 |
| WO | 2009124197 | A2 | 10/2009 |

OTHER PUBLICATIONS

Medairos, David "How to turn a speaker into a microphone." Jun. 4, 2010. pp. 1-2. http://www.ehow.com/how_6588913_turn-speaker-microphone.html.*

Yozwiak, Jeffrey "Livescribe Pulse smartpen review and ratings." Aug. 12, 2009. pp. 1-5. http://www.computershopper.com/mice/reviews/livescribe-pulse-smartpen.*

TecnoAdicto "Differences between the Echo smartpen and Livescribe Pulse smartpen." Dec. 28, 2010. pp. 1-3. http://www.tecnoadicto.net/blog/2010/12/diferencias-entre-el-echo-smartpen-y-el-pulse-smartpen-de-livescribe/.*

Notification of Transmittal of the International Search Report and the Written Opinion of the International Searching Authority, PCT/US2011/033138, Aug. 21, 2013.

State Intellectual Property Office Search Report, CN App. No. 2011800701824, Dated Jul. 22, 2015.

* cited by examiner

SMARTPEN CONFIGURED FOR HANDS FREE AUDIO RECORDING

CROSS-REFERENCE TO RELATED APPLICATION

The present application is a continuation application under 35 U.S.C. §120 of International Application PCT/US2011/033138, filed on Apr. 20, 2011 and entitled "SMARTPEN CONFIGURED FOR HANDS FREE AUDIO RECORDING." The International Application, including any appendices or attachments thereof, is incorporated by reference herein in its entirety.

BACKGROUND

Unless otherwise indicated herein, the approaches described in this section are not prior art to the claims in this application and are not admitted to be prior art by inclusion in this section.

Audio-recording digital pens, or "smartpens," can simultaneously record audio data and capture hand-written notes, allowing a user to record conversations or other audio occurring at the same time the user writes notes. The recorded audio and captured handwriting can be stored in a manner that preserves the temporal relationship between the recorded audio data and the captured handwriting, thereby providing context and clearer meaning for the hand-written notes. For example, a note-taking "movie" can be played, which replays the notes as they were written while simultaneously replaying the recorded audio. In another example, some smartpens can link portions of the captured audio with specific words, symbols, and/or figures contained in the hand-written notes. In addition, smartpens used in conjunction with text-recognition technology facilitate the automated conversion of hand-written notes into an electronic text format. Thus, in many ways, smartpens are becoming an invaluable tool for collecting information during meetings or lectures that can be conveniently retrieved at a later time.

SUMMARY

In one or more embodiments of the present disclosure, a digital pen apparatus may include a substantially cylindrical body with components disposed in the substantially cylindrical body. The components, including a microphone, can be arranged within the cylindrical body such that a weight distribution associated with the components may cause the substantially cylindrical body to orient the microphone for unobstructed reception of ambient sound when the substantially cylindrical body is placed on a supporting surface.

In one or more embodiments of the present disclosure, a digital pen apparatus may include a substantially cylindrical body, components, including a microphone, may be disposed in the substantially cylindrical body, and a surface feature may be disposed on a surface of the substantially cylindrical body. The surface feature can be configured to orient the microphone for unobstructed reception of ambient sound when the substantially cylindrical body is placed on a supporting surface.

In one or more embodiments of the present disclosure, a digital pen apparatus may include an elongated body substantially similar in size and shape to a writing pen and components disposed in the elongated body. The components, including a microphone, can be configured such that a weight distribution associated with the components relative to the elongated body causes the elongated body to roll and orient the microphone for unobstructed reception of ambient sound when the elongated body is placed on a supporting surface.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
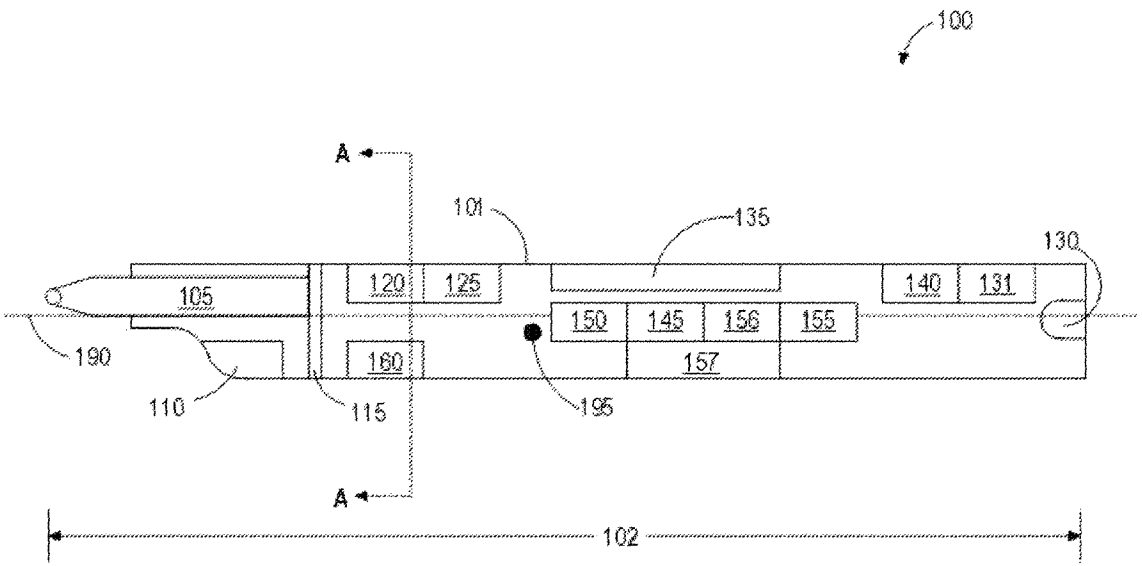
FIG. 1 shows a schematic cross-sectional side view of an illustrative embodiment of a smartpen.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the disclosure, as generally described herein, and illustrated in the Figures, can be arranged, substituted, combined, and designed in a wide variety of different configurations, all of which are explicitly contemplated and make part of this disclosure.

While smartpens are a valuable tool for digitally capturing information during meetings or lectures, they also have certain drawbacks. For example, it is sometimes desirable to set down a smartpen on a supporting surface and use it as a hands-free audio-recording device. Once set down, the smartpen tends to roll and sometimes the microphone ends up in an unwanted orientation, such as pointed downward and towards the supporting surface. When the microphone of the smartpen is not oriented correctly, fidelity of any recorded audio can be significantly compromised. In addition, the tendency of a smartpen to roll can result in serious damage to the smartpen should it roll off of the support surface and fall.

This disclosure is drawn, inter alia, to methods, apparatus, and systems related to a smartpen configured for use as a hands-free audio recording device. In one or more embodiments of the present disclosure, a smartpen may be configured so that a microphone contained in the smartpen is oriented for unobstructed reception of ambient sound when the smartpen is placed on a supporting surface. In one or more embodiments of the present disclosure, a weight distribution within the smartpen causes the smartpen to roll to a desired orientation of the microphone when the smartpen is placed on a supporting surface with the microphone in a different orientation. In one or more embodiments of the present disclosure, one or more surface features disposed on a surface of the body of the smartpen are configured to position the microphone in a desired orientation when the smartpen is placed on a supporting surface.

FIG. 1 shows a schematic cross-sectional side view of an illustrative embodiment of a smartpen 100, arranged in accordance with at least some embodiments described herein. Smartpen 100 is a writing-pen-based data collection system configured to capture audio and hand-written data concurrently so that pen strokes and audio are digitally stored and temporally linked. Smartpen 100 may be configured with the features of any such writing-pen-based data collection system known in the art and still fall within the scope of the present disclosure. Thus, smartpen 100 may include the data collection functionality of one or more smartpens known in the art. For example, smartpen 100 may be configured to record audio data and capture hand-written notes so that a note-taking movie displays the hand-written notes as they were written while simultaneously replaying the recorded audio. In another example, smartpen 100 may be configured to link portions of the captured audio with specific words, symbols, and/or figures contained in the hand-written notes. In yet another example, smartpen 100 may be configured for automated conversion of hand-written notes into an electronic text format.

Smartpen 100 may have a body 101 substantially similar in size and shape to a writing pen or other writing implement, e.g., elongated and substantially cylindrical, although certain variations on the general shape may exist to accommodate other functions of the pen. For example, smartpen 100 may have a slightly larger diameter than a standard pen to accommodate components described below. Smartpen 100 may also have additional structural features not generally associated with the writing-pen-shaped form factor, such as a flat display screen, an imaging lens, etc. In addition, smartpen 100 may vary in cross-section along some or all of length 102, both for ergonomic reasons and to further accommodate the disposition of components within body 101.

As shown in FIG. 1, smartpen 100 may include a marker 105, an imaging system 110, a pen down sensor 115, a microphone 120, a speaker 125, an audio jack 130, wireless interface 131, a display 135, an I/O port 140, a processor 145, an onboard memory 150, a battery 155, a charging circuit 156, a heat sink 157, and a counterbalance element 160. It should be understood, however, that not all of the above components are required for each embodiment of smartpen 100, and this is not an exhaustive list of components for all embodiments of smartpen 100 or of all possible variations of the above components. For example, smartpen 100 may also include control buttons, such as a power button and/or an audio recording button, status indicator lights, etc. Moreover, as used herein in the specification and in the claims, the term "smartpen" does not imply that the pen device has any particular feature or functionality described herein for a particular embodiment, other than those features expressly recited for that embodiment. Thus, a smartpen as defined herein may have any combination of the capabilities and subsystems described herein.

Marker 105 enables smartpen 100 to be used as a traditional writing apparatus for writing on any suitable surface. Marker 105 may comprise any suitable marking mechanism, such as a replaceable ballpoint pen element. Marker 105 may be coupled to a pen down sensor 115 that produces an output when marker 105 is pressed against a surface, thereby indicating when smartpen 100 is being used to write on a surface. Pen down sensor 115 may comprise a pressure-sensitive element or other sensor capable of detecting contact between marker 105 and a writing surface.

Imaging system 110 comprises optics and sensors for imaging an area of a writing surface near marker 105. The writing surface may include an encoded pattern. By capturing and processing images of the encoded pattern, smartpen 100 can determine where marker 105 is and what it writes.

Microphone 120 is another data capture device on smartpen 100, which allows smartpen 100 to perform audio capture. Alternatively, one or more external microphones (not shown) may be positioned separately from smartpen 100 and communicate captured audio data to smartpen 100 via audio jack 130 or via wireless interface 131.

Speaker 125, audio jack 130, and display 135 provide outputs to the user, including recorded audio output, user prompts, a digitized version of captured hand-written characters, etc. Audio jack 130 may also be used as an input from external microphones. In some embodiments, speaker 125 may be configured to also function as microphone 120 for smartpen 100 by using back EMF (electromotive force) generated by the diaphragm of speaker 125 when ambient sound is incident thereon.

I/O port 140 allows communication between smartpen 100 and an external computing system (not shown), e.g., a personal computer, as part of normal operation of smartpen 100. Content captured by smartpen 100 may be transferred to the external computing system for further use by said computing system. Conversely, content and/or software applications executable by smartpen 100 may also be transferred to smartpen 100 from the external computing system via I/O port 140. In some embodiments, smartpen 100 may include wireless interface 131 in lieu of or in addition to I/O port 140.

Processor 145, in conjunction with onboard memory 150, can be configured to capture written and audio data and to synchronize the written data with the audio data. Processor 145 can be coupled to I/O port 140, audio jack 130, microphone 120, and/or speaker 125, thereby enabling applications running on smartpen 100 to use one or more of those components. In some embodiments, processor 145 may be a single-chip processor, and onboard memory 150 may include random access memory (RAM) and flash memory or another persistent memory. Consequently, executable applications, such as character or voice recognition algorithms, can be stored and executed on smartpen 100. In addition, recorded audio and handwriting can be stored on smartpen 100, either indefinitely or until offloaded from smartpen 100 to an external computing system.

Smartpen 100 may also include battery 155 or other suitable power source, heat sink 157, and counterbalance element 160. Battery 155 may be a rechargeable battery, in which case smartpen 100 may further include a charging circuit 156. Heat sink 157 is a heat transfer device configured to help to cool one or more components of smartpen 100, such as charging circuit 156, the light source for imaging system 110, display 135, and/or processor 145.

Counterbalance element 160 is a component positioned in body 101 so that the weight distribution of the components of smartpen 100 causes smartpen 100 to roll to a desired position to orient microphone 120 for unobstructed reception of ambient sound when placed on a supporting surface. For example, it may be desirable to orient microphone 120 upward and away from the supporting surface. To ensure smartpen 100 rolls to a position that places microphone 120 near the top, counterbalance element 160 and microphone 120 may be located in opposite halves of body 101 so a center of gravity 195 of smartpen 100 is located below a central axis 190 of body 101. In one or more embodiments, counterbalance element 160 may be relatively massive with respect to other components of smartpen 100 to achieve the desired weight distribution. In one or more other embodiments, smartpen 100 does not include counterbalance element 160 since the other components of smartpen 100 can be positioned to achieve the desired weight distribution. Such embodiments are described below in conjunction with FIG. 3.

Figure 2:
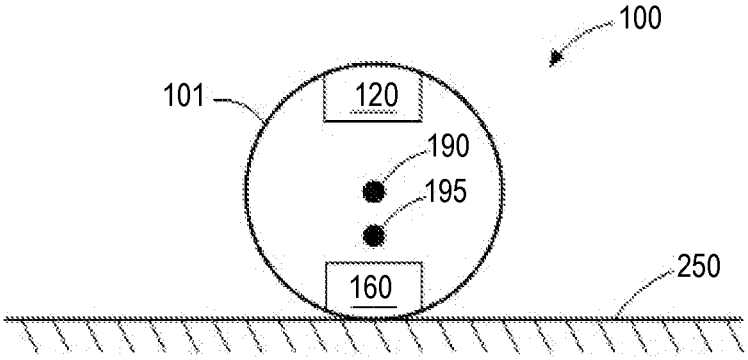
FIG. 2 shows a schematic cross-sectional view of an illustrative embodiment of a smartpen resting on a supporting surface.

FIG. 2 shows a schematic cross-sectional view of an illustrative embodiment of smartpen 100 resting on a supporting surface 250, arranged in accordance with at least some embodiments described herein. The cross-sectional view in FIG. 2 is taken at section A-A in FIG. 1. Supporting surface 250 may be any substantially horizontal and relatively smooth surface, such as a tabletop, book, notebook, etc. As shown, counterbalance element 160 is positioned on the opposite half of body 101 from microphone 120 so that center of gravity 195 of smartpen 100 is positioned below central axis 190 and microphone 120 faces upward and away from supporting surface 250. When placed on supporting surface 250, smartpen 100 can roll to a position that orients microphone 120 up and away from supporting surface 250. In this way, microphone 120 is automatically oriented for unobstructed reception of ambient sound when smartpen 100 is used as a hands-free audio recording device.

Figure 3:
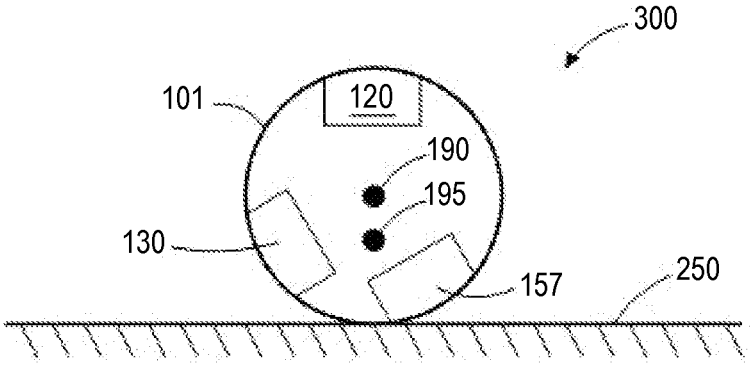
FIG. 3 shows a schematic cross-sectional view of an illustrative alternate embodiment of a smartpen resting on a supporting surface, in which no counterbalance element is used to achieve the desired weight distribution of the smartpen.

FIG. 3 shows a schematic cross-sectional view of an illustrative alternate embodiment of a smartpen 300 resting on supporting surface 250, in which no counterbalance element 160 is used to achieve the desired weight distribution of smartpen 100, in accordance with at least some embodiments described herein. Instead, one or more components of smartpen 300 are positioned in body 101 so that center of gravity 195 of smartpen 300 is positioned below central axis 190 and microphone 120 faces upward and away from supporting surface 250. In the illustrative embodiment shown in FIG. 3, one or more relatively massive components of smartpen 300 are positioned in this way, such as heat sink 157 and/or audio jack 130.

Figure 4:
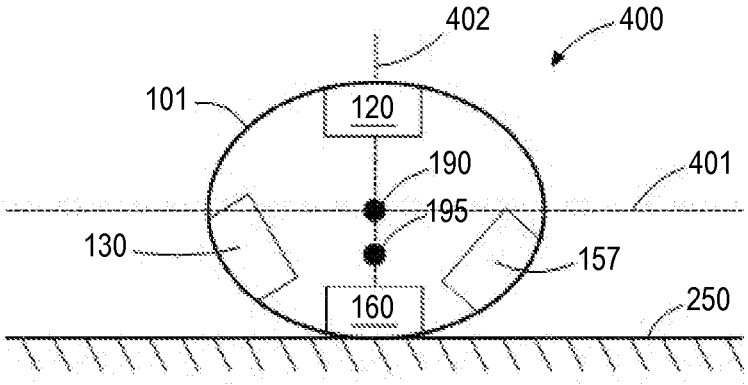
FIG. 4 shows a schematic cross-sectional view of an illustrative alternate embodiment of a smartpen, in which at least a portion of the body of the smartpen is non-circular in cross-section.

FIG. 4 shows a schematic cross-sectional view of an illustrative alternate embodiment of a smartpen 400, in which at least a portion of body 101 is non-circular in cross-section, arranged in accordance with at least some embodiments described herein. As shown, smartpen 400 rests on supporting surface 250. In such embodiments, smartpen 400 may have a non-circular cross-section for at least a portion of body 101 that is selected to further encourage smartpen 400 to roll into a desired orientation, e.g., where microphone 120 is positioned for unobstructed reception of ambient sound when smartpen 400 is placed on supporting surface 250. For example, the non-circular cross-section of smartpen 400 may be a shape having a major axis 401 and a minor axis 402, such as an ovoid or ellipse. As microphone 120 and center of gravity 195 can be positioned on opposite sides of major axis 401, smartpen 400 is encouraged to roll into an orientation in which microphone 120 faces upward and away from supporting surface 250.

Figure 5:
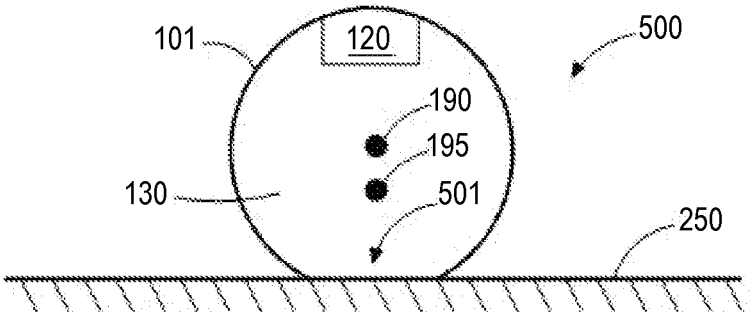
FIG. 5 shows a schematic cross-sectional view of an illustrative alternate embodiment of a smartpen, in which one or more surface features are disposed on a surface of the body of the smartpen and are configured to orient a microphone for unobstructed reception of ambient sound when the smartpen is placed on a supporting surface.

FIG. 5 shows a schematic cross-sectional view of an illustrative alternate embodiment of a smartpen 500, in which one or more surface features are disposed on a surface of body 101 and are configured to orient microphone 120 for unobstructed reception of ambient sound when smartpen 500 is placed on a supporting surface, in accordance with at least some embodiments described herein. As shown, smartpen 500 rests on supporting surface 250 and a flat portion 501 disposed on the surface of body 101 ensures that smartpen 500 is oriented so that microphone 120 faces upward and away from supporting surface 250. Flat portion 501 may extend along the entire length of smartpen 500 or just a portion of smartpen 501. In some embodiments, smartpen 500 is configured with a weight distribution that further encourages smartpen 500 to roll into an orientation where microphone 120 has unobstructed reception of ambient sound when smartpen 500 is placed on supporting surface 250. In some embodiments, smartpen 500 also has a non-circular cross section that further encourages smartpen 500 to roll into an orientation where microphone 120 has unobstructed reception of ambient sound when smartpen 500 is placed on supporting surface 250.

Figure 6:
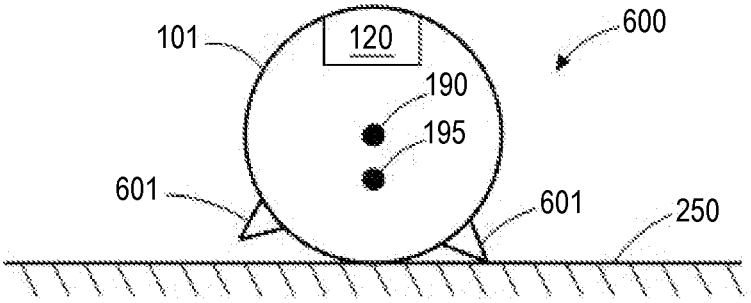
FIG. 6 shows a schematic cross-sectional view of an illustrative alternate embodiment of a smartpen, in which the one or more surface features disposed on a surface of the body of the smartpen are projections.

FIG. 6 shows a schematic cross-sectional view of an illustrative alternate embodiment of a smartpen 600, in which the one or more surface features disposed on a surface of body 101 are projections, in accordance with at least some embodiments described herein. As shown, one or more projections 601 are disposed on a surface of body 101 and are configured to orient microphone 120 for unobstructed reception of ambient sound when the substantially cylindrical body is placed on supporting surface 250.

According to some embodiments, the desired orientation of microphone 120 may not be facing upward and away from supporting surface 250, as illustrated in FIGS. 2-6. Rather than being configured to receive ambient sounds via air coupling, microphone 120 may be configured to receive ambient sounds via supporting surface 250. In such embodiments, the optimal orientation of microphone 120 may be facing directly toward and/or contacting supporting surface 250.

Figure 7:
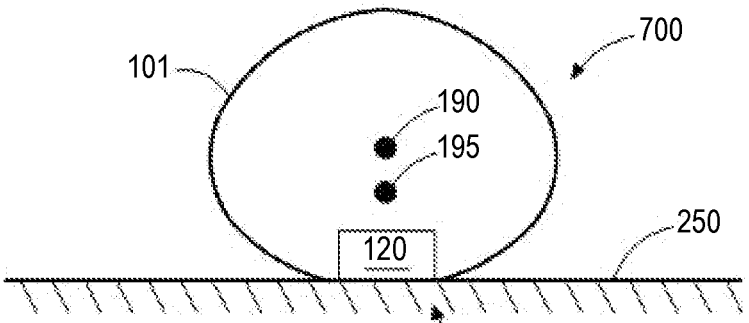
FIG. 7 shows a schematic cross-sectional view of an illustrative alternate embodiment of a smartpen, in which the microphone is oriented for unobstructed reception of ambient sound via the supporting surface.

FIG. 7 shows a schematic cross-sectional view of an illustrative alternate embodiment of a smartpen 700, in which microphone 120 is oriented for unobstructed reception of ambient sound via supporting surface 250, in accordance with at least some embodiments described herein. In one or more embodiments, the weight distribution of smartpen 700 may be configured so that center of gravity 195 and microphone 120 are positioned on the same half of body 101 so that smartpen 700 will roll to a position that orients microphone 120 toward and/or in contact with supporting surface 250. In one or more embodiments, body 101 may be non-circular in cross-section, as described above in conjunction with FIG. 4, to further encourage smartpen 700 to roll into a desired orientation when placed on supporting surface 250. In some embodiments, one or more surface features, such as a flat 702 or projections (not shown), may be disposed on a surface of body 101 and configured to orient microphone 120 toward supporting surface 250.

Figure 8:
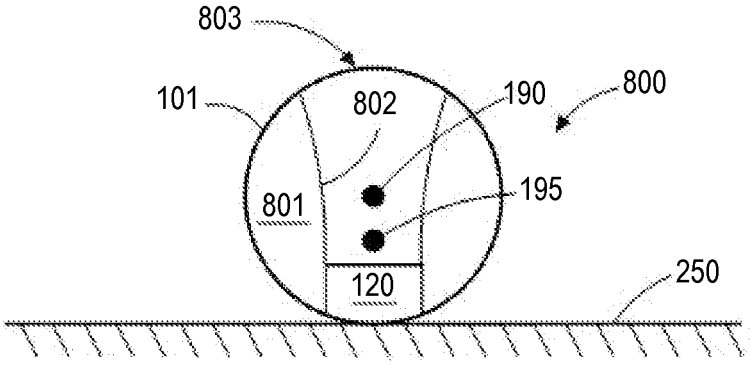
FIG. 8 shows a schematic cross-sectional view of an illustrative alternate embodiment of a smartpen 800, in which the microphone is positioned in an inner region of the body of the smartpen, all arranged in accordance with at least some embodiments described herein.

In FIG. 1, microphone 120 is depicted adjoining an external surface of body 101. In some embodiments, microphone 120 may be positioned in an inner region of body 101 and is acoustically coupled to the exterior of body 101 via air coupling. FIG. 8 shows a schematic cross-sectional view of an illustrative alternate embodiment of a smartpen 800, in which microphone 120 is positioned in an inner region 801 of body 101, arranged in accordance with at least some embodiments described herein. As shown, microphone 120 can be acoustically coupled via a horn 802 and air coupling to ambient sound. In such embodiments, opening 803 of horn 802 and microphone 120 may be positioned on opposite halves of body 101. Consequently, microphone 120 may be used as a component of smartpen 800 that is effective to position center of gravity 195 below central axis 190 when smartpen 800 is placed on supporting surface 250. Because opening 803 of horn 802 is oriented upward and away from supporting surface 250, microphone 120 has unobstructed reception of ambient sound when smartpen 800 is placed on supporting surface 250.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general, such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. A digital pen apparatus that captures pen strokes and audio, the digital pen apparatus comprising:

a substantially cylindrical body; and components disposed in the substantially cylindrical body, wherein the components include a microphone, wherein the components are arranged and fixed within the substantially cylindrical body such that a weight distribution associated with the components causes the substantially cylindrical body to orient the microphone for reception of ambient sound when the substantially cylindrical body is placed on a supporting surface, wherein the weight distribution associated with the components is configured to cause the substantially cylindrical body to roll to an orientation of the microphone for reception of the ambient sound when the substantially cylindrical body is placed on the supporting surface with the microphone in a different orientation, wherein the ambient sound is received by the microphone primarily via the supporting surface rather than via air coupling when the substantially cylindrical body is placed on the supporting surface, and the weight distribution associated with the components orients the microphone toward and in contact with the supporting surface, wherein the weight distribution associated with the components is configured to position a center of gravity of the components below a central axis of the substantially cylindrical body when the substantially cylindrical body is placed on the supporting surface, wherein the microphone and the center of gravity are positioned on a same side below the central axis such that the microphone is oriented downward toward and in contact with the supporting surface, when the substantially cylindrical body is placed on top of the supporting surface, for reception of the ambient sound via the supporting surface rather than via the air coupling, wherein the components further include a heat sink and a counterbalance element, wherein the heat sink is positioned on a same side as the center of gravity, and wherein positioning the center of gravity below the central axis is independent of the counterbalance element.

2. The digital pen apparatus of claim 1, wherein the supporting surface is a substantially horizontal surface.

3. The digital pen apparatus of claim 1, wherein the components further include one or more of a battery, a loudspeaker, an imaging system, a processor, a memory, and/or an input/output (I/O) port.

4. The digital pen apparatus of claim 1, wherein the substantially cylindrical body comprises a non-circular cross-section.

* * * * *